US006602050B1

(12) United States Patent
Scheurlen et al.

(10) Patent No.: US 6,602,050 B1
(45) Date of Patent: Aug. 5, 2003

(54) COVERING ELEMENT AND ARRANGEMENT WITH A COVERING ELEMENT AND A SUPPORT STRUCTURE

(75) Inventors: Michael Scheurlen, Mülheim A.D. Ruhr (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/937,214

(22) PCT Filed: Mar. 15, 2000

(86) PCT No.: PCT/EP00/02296

§ 371 (c)(1),
(2), (4) Date: Sep. 24, 2001

(87) PCT Pub. No.: WO00/57033

PCT Pub. Date: Sep. 28, 2000

(30) Foreign Application Priority Data

Mar. 24, 1999 (EP) ..... 99105944

(51) Int. Cl.[7] ..... F01D 5/20
(52) U.S. Cl. ..... 415/173.1

(58) Field of Search ..... 415/115, 173.1, 415/173.3, 209.2, 134, 175, 189, 190, 208.1

(56) References Cited

U.S. PATENT DOCUMENTS

| | | | |
|---|---|---|---|
| 3,892,497 | A | 7/1975 | Gunderlock |
| 5,127,793 | A | 7/1992 | Walker et al. |
| 5,167,488 | A | 12/1992 | Ciokajlo et al. |
| 5,288,206 | A | 2/1994 | Bromann et al. |
| 5,320,487 | A | 6/1994 | Walker et al. |

FOREIGN PATENT DOCUMENTS

| | | |
|---|---|---|
| GB | 2 019 954 | 4/1978 |

*Primary Examiner*—Edward K. Look
*Assistant Examiner*—Kimya N McCoy
(74) *Attorney, Agent, or Firm*—Harness, Dickey & Pierce, P.L.C.

(57) ABSTRACT

A covering element is for the protection of components in a machine subjected to high thermal load, in particular of components in a gas turbine. The covering element includes a wall with a hot side capable of being exposed to a hot medium, and with a cool side located opposite the hot side. The cooling side includes a cooling surface capable of being acted upon by a coolant. Holding elements are provided on the cool side.

33 Claims, 6 Drawing Sheets

COVERING ELEMENT AND ARRANGEMENT WITH A COVERING ELEMENT AND A SUPPORT STRUCTURE

This application is the national phase under 35 U.S.C. §371 of PCT International Application No. PCT/EP00/02296 which has an International filing date of Mar. 15, 2000, which designated the United States of America, the entire contents of which are hereby incorporated by reference.

FIELD OF THE INVENTION

The invention relates to a covering element for the protection of components in a machine subjected to high thermal load, in particular of components in a gas turbine. The invention relates, furthermore, to an arrangement with a covering element and with a carrying structure.

BACKGROUND OF THE INVENTION

Components in a machine subjected to high thermal load are exposed to high temperatures during the regular operation of this machine. In a thermal machine, in particular in a gas turbine, a hot medium, for example a hot gas, subjects to a very high thermal load, primarily the surfaces, limiting the hot medium and the associated components. Furthermore, as a result of the transport of heat through these limiting surfaces, such as occurs, for example, in the form of heat conduction or heat radiation, even components which are not directly exposed to the hot medium and are often installed in the casing of the machine are subjected to high thermal loads. The components exposed to the hot medium thus perform two functions: enclosing the hot medium and protecting other, possibly less heat-resistant components from overheating or thermal destruction. Consequently, above all, material properties and the design and mounting of these components subjected to high thermal load must satisfy stringent requirements. Moreover, requirements regarding the coolability of such components must often also be taken into account.

For example, when a gas turbine is in operation, loads arise from mechanical stress (for example, due to internal pressure, centrifugal force, external forces and moments) and as a result of thermal stresses which occur because the thermal expansion of components in the event of temperature differences is prevented. Whereas, during steady-state operation, the temperature differences and therefore the thermal stresses are generally low, as compared with the mechanical stress, during transient operation in the event of load changes and in start-up and shut-down actions the transient thermal stresses are usually decisive, since load changes are necessarily associated with temperature changes. In the case of high working temperatures and large temperature differences between the individual load states, therefore, corresponding thermal expansions occur which affect primarily the casings and the rotors.

U.S. Pat. No. 3,892,497 describes an axial gas turbine with an inner and an outer casing insert. Guide blades and moving blades are arranged along a turbine axis in the gas turbine. A guide blade has in each case a platform (guide blade root) which serves for fastening the guide blade to the inner casing insert. Between in each case two adjacent guide blades spaced axially from one another, a guide ring is arranged on the inner casing insert in such a way that the guide ring is contiguous to the corresponding platforms of the guide blades. The platforms and guide rings are held from inside by the inner casing insert and are connected to the latter by a carrying element. Each carrying element is in this case connected fixedly to the inner casing insert by means of a combination consisting of a locking plate with a screw engaging into the inner casing insert.

The platforms of the guide blades and the guide rings have grooves into which the carrying element engages. A carrying element in this case engages into a groove either in a platform or in a guide ring, engagement taking place in the axial direction in each case at the edge of the platform or guide ring. This fastening to some extent allows relative thermal expansion and contraction between mutually contiguous components in the axial direction and, furthermore, permits simplified assembly and maintenance of the gas turbine. Moreover, a fastening for a guide ring may be gathered from the patent specification, in which a rigid connection to the guide ring is made directly by means of a fixing screw guided radially through the inner casing insert. In this case, the fixing screw secures the guide ring locally at a point between the axial edges of the latter. This embodiments results, when the guide ring is under thermal load, in considerable local thermal stresses in the axial direction and, above all, in the radial direction, since thermal expansions are possible only to a very restricted extent.

SUMMARY OF THE INVENTION

An object on which the invention is based is to specify a component capable of being subjected to high thermal load and at the same time of being cooled as efficiently as possible. The component, in this context, is to be suitable for use in the case of high working temperatures and large temperature differences between various states of load. Another object of the invention is to specify an arrangement with a component and with a carrying structure, which makes it possible, in particular, to fasten the component in the carrying structure in a way which is tolerant to thermal expansion.

The first-mentioned object is achieved, according to the invention, by means of a covering element which has a longitudinal axis and a transverse axis, comprising a wall with a hot side capable of being exposed to a hot medium and with a cool side which is located opposite the hot side and which has a cooling surface capable of being acted upon by a coolant, and further comprising a first bearing region, contiguous to the wall along the longitudinal axis and having a first bearing surface, and a second bearing region, located opposite the first bearing region along the longitudinal axis and having a second bearing surface, and further comprising a first edge region contiguous to the wall along the transverse axis and a second edge region located opposite the first edge region along the transverse axis, there being provided on the cool side a holding element which is arranged between the first and the second bearing region.

The invention proceeds from the notion that a component in a thermal machine, said component being exposed to a hot medium, for example a hot gas or steam, is subjected to very high thermal load by the temperature of the medium. These high temperatures or large temperature changes are associated with heat-induced deformations, above all thermal expansions, which are to be taken into account in the design and mounting of such components. The invention affords a novel possibility for designing and arranging components in a way which is tolerant to thermal expansion in machines subjected to high thermal load.

An above covering element forms, with its hot side capable of being exposed to the hot medium, a defined limitation of the hot medium, for example of the hot gas, in the combustion chamber or in the flow duct of a gas turbine. Furthermore, the covering element, as a component capable of being subjected to high thermal load, serves for the protection of further, possibly less heat-resistant components which are not exposed to the hot medium directly and are arranged in the casing of the thermal machine, in particular of the gas turbine. In this function, the covering element prevents the thermal overloading or even destruction of these components. Provided on the cool side of the covering element is a holding element which is arranged between the first and the second bearing region. The holding element is a fixed integral part of the covering element and has the task of ensuring an additional hold between the first and the second bearing region. The covering element is in this case held via the holding element from the cool side in such a way that, in particular, forces directed perpendicularly to the wall, for example as a result of mechanical and/or thermal load on the wall, can be absor-bed efficiently and, if appropriate, also transmitted efficiently.

At the same time, very good cooling properties of the cooling element can be ensured. This is implemented in that the first and the second bearing region are contiguous to the wall along the longitudinal axis. The side of the wall which is located opposite the hot medium is thereby available virtually completely as a cooling surface. By virtue of this design, the cooling surface is capable of being acted upon uniformly by a coolant, for example cooling air, with the result that highly homogeneous cooling becomes possible.

It also has a particularly advantageous effect on the use of coolant, since the cooling surface is designed as a coherent surface and, as a result, the coolant, insofar as it is supplied at a point on the cool side, can reach all the regions of the cooling surface. Additional coolant feeds or coolant leadthroughs therefore become unnecessary, which is highly advantageous, above all, in light of the production costs.

The good cooling properties of the covering element also have a particularly beneficial effect on temperature distribution within the wall of the covering element. Consequently, temperature gradients occur essentially only perpendicularly to the cooling surface, that is to say from the hot side in the direction of the cool side. Thermal stresses along the longitudinal or transverse axis of the covering element, which could possibly induce cracks, are thereby as far as possible avoided.

The proposed covering elements proves highly advantageous also in terms of mechanical stability. This is primarily in regard to the forces which occur due to possible pressure differences which may prevail between the hot side and the cool side of the covering element. Both the mechanical load and the above-described thermal load on the covering element lead to a deformation of the wall which is normally manifested in a flexion of the wall in the direction of the hot side. This effect is restricted to a defined amount by virtue of the invention.

Preferably, a further holding element is arranged on the cooling surface, on the first or on the second edge region. A further holding element affords the possibility of giving the covering element an additional hold at a further point from the cool side of the wall. The overall load due to mechanically and/or thermally induced forces perpendicular to the wall is thereby distributed to a plurality of holding elements, with the result that the load per holding element becomes correspondingly lower. Possible flexions of the wall in the direction of the hot side as a result of these forces are thereby either further restricted or can be limited to a predetermined amount by virtue of an appropriate arrangement of the holding element. Furthermore, the good cooling properties of the covering element are maintained due to the further holding elements, that is to say, above all, the design of a coherent cooling surface on the cool side. Various combinations of two holding elements can be implemented, which lead to the same desired result in terms of a predetermined maximum deformation of the wall. This affords a certain amount of freedom with regard to the arrangement of the holding elements.

The holding element preferably has a holding bearing surface. The holding element has, also preferably, a recess, in particular a groove, for engagement into a carrying structure. By virtue of this design, it is possible, via the holding element, in combination with the first and the second bearing region and also with a carrying structure, to implement an arrangement tolerant to thermal expansion, with the covering element and with a carrying structure. The production of the holding bearing surface as a subsurface of the recess, in particular of the groove, in the holding element can be carried out in a simple way in manufacturing terms. The recess could be produced, for example, by the milling of a groove or, where a casting is concerned, by laying bare by means of a simple core during casting. The holding bearing surface serves for absorbing the forces as a result of thermal and/or mechanical load on the covering element and for transmitting them effectively to a carrying structure. The occasionally considerable forces are not point-transmitted by the holding bearing surface, but are distributed over an area. Thus, for a given termal or mechanical load, the load per area can be limited, by appropriate dimensioning of the holding bearing surface, to an amount adapted to the material properties of the covering element.

The wall preferably has a wall thickness of between about 1.0 mm and 5.0 mm, in particular between about 1.5 mm and 3.0 mm. The wall is consequently made comparatively thin, as compared with the first and the second bearing region of the first or the second edge region of the covering element. Depending on the application, during operation, the temperature difference between the wall's hot side acted upon by the hot medium and the wall's cool side acted upon by the coolant may be very large. For example, when the covering element is used in a gas turbine, temperature differences between the hot gas and the coolant, in particular the cooling air extracted from the compressor of the gas turbine, of up to 800° C. may occur. It is therefore of decisive advantage to make the wall as thin as possible, so that the temperature gradient between the hot side and the cool side of the wall becomes as high as possible and the heat can be discharged very efficiently, with the smallest possible amount of coolant being used. An efficient heat discharge takes place predominantly by means of the coolant. A small fraction of the heat flow flowing from the hot side into the wall may also be diverted along the longitudinal axis and the transverse axis into the first/second bearing region and the first/second edge region of the covering element, since these regions constitute an additional heatsink because their cross section is greater than that of the wall.

The cooling surface preferably has a supporting structure for increasing the rigidity and thermal conductivity. The increase in the rigidity of the covering element by means of the supporting structure on the cooling surface has a highly advantageous effect on the prevention of deformations, in particular of deformations and flexions of the wall in the direction of the hot side of the wall. Furthermore, this supporting structure has the effect of enlarging the effective cooling surface, thus leading to an increase in cooling efficiency. In addition to enlarging the effective cooling surface, the supporting structure ensures an improved intermixing of coolant at different temperatures in the immediate vicinity of the cooling surface. As a result, on average, the temperature on the cooling surface decreases, and the temperature gradient and, correspondingly, the transport of heat by the coolant are increased. In addition, since the cross section of the supporting structure is larger than that of the wall, thermal conductivity along the supporting structure is increased somewhat.

Preferably, the supporting structure is formed by at least one longitudinal rib along the longitudinal axis on the cooling surface. Also preferably, the supporting structure has a further longitudinal rib which is formed along the longitudinal axis on the cooling surface. The design of the supporting structure in the form of one or more longitudinal ribs is a solution which is highly beneficial in terms of production and which, for example in the case of a casting, can be implemented simply and cost-effectively. As regards the improved thermal conduction properties, this design leads to a transport of heat through the longitudinal ribs in the direction of the first and the second bearing region of the covering element. At the same time, the longitudinal ribs increase the rigidity of the component, which, in turn, is advantageous in terms of possible deformations, in particular flexions of the wall from the cool side toward the hot side, under thermal or mechanical load.

Preferably, at least two longitudinal ribs spaced in the direction of the transverse axis are connected to a holding element. By virtue of this design, the holding element may be interpreted, as it were, as part of the supporting structure. This version serves for increasing the rigidity and for increasing the thermal conductivity, but, above all, the mechanical and thermal stability of the covering element under high thermal and/or compressive load. It is advantageous, once again, that this version can be implemented in a simple way in manufacturing terms.

Preferably, the number and arrangement of the holding elements are defined by a predetermined thermal flexion of the wall. Also preferably, the predetermined thermal flexion is 0.1 mm to 1.0 mm, in particular 0.3 mm to 0.7 mm. The thermal flexion which occurs depends, in this case, on the thermal load and/or compressive load on the covering element and on its material properties and also on the design, predominantly in terms of the number and arrangement of the holding elements. In the case of a typical temperature difference between the hot side and the cool side of the covering element of approximately 800° C., such as occurs, for example, in a steady-state gas turbine, the limits specified above for the thermal flexion are reasonable values. In an actual application, it will be necessary to find a suitable configuration by means of computer-assisted optimization of the concurrent requirements between the flexion of the wall, on the one hand, and, in accompaniment with this, a number and arrangement of holding elements on the cooling surface, and an acceptable restriction of the effective cooling surface by the holding elements, on the other hand. A proposed concept therefore affords very high flexibility with regard to adaption to an actual set object.

Preferably, at least two holding elements are arranged, spaced from one another, along the transverse axis. Also preferably, at least two holding elements are arranged, spaced from one another, along the longitudinal axis. In the case of covering elements which are dimensioned such that they extend predominantly along the longitudinal axis or along the transverse axis, a plurality of holding elements are provided along the respective preferential axis. This version is closely adapted to the symmetry properties of the covering element and, in the case of a predetermined thermal flexion of the wall, manages with as small a number of holding elements as possible. As regards covering elements which extend appreciably along both a longitudinal axis and a transverse axis, holding elements are arranged preferably in both dimensions, in order to achieve the desired effect. It is advantageous, in this case, if the holding elements are arranged, spaced from one another, and the cooling surface thus always remains a coherent surface in all the embodiments. The cooling air can thereby flow, unimpeded, from one point on the cooling surface to another point on the cooling surface, and there is no need for additional coolant feeds or coolant leadthroughs.

The object based on an arrangement is achieved, according to the invention, by means of an arrangement with a covering element according to one of the above versions and with a carrying structure which has a longitudinal axis, a transverse axis and a first receiving region arranged along the longitudinal axis and having a first receiving surface and also a second receiving region located opposite along the longitudinal axis and having a second receiving surface, and a carrying element with a carrying surface, the first receiving region being contiguous to the first bearing region and the second receiving region to the second bearing region, and the holding element and the carrying element overlapping one another, the holding bearing surface and the carrying surface being located opposite one another.

Preferably, without any thermal load, in particular at room temperature, the holding bearing surface and the carrying surface are spaced from one another by a gap. The covering element is usually inserted into the carrying structure at room temperature. Since the first receiving region is contiguous to the first bearing region and the second receiving region to the second bearing region, the covering element is already held in a carrying structure. The spacing of the holding bearing surface of the holding element and the carrying surface of the carrying element by means of a gap proves to be highly beneficial in terms of the mounting of the covering element in the carrying structure. When the thermal machine, in particular a gas turbine, is in operation, that is to say under high thermal and mechanical load, the wall of the covering element tends to flex in the direction of the hot side. The holding bearing surface on the carrying surface therefore come into congruence, and the forces resulting from the thermal load are absorbed effectively. The spacing, selected at room temperature, between the holding bearing surface and the carrying surface is decisive as to the thermal load at which the holding bearing surface and the carrying surface come into congruence and therefore as to the thermal flexion of the wall which occurs. In the thermally highly loaded state, the covering element is thereby held firmly in the carrying structure, the thermal flexion of the wall in the direction of the hot side being predeterminable, in particular being capable of being restricted to a maximum value.

Preferably, one configuration formed between the receiving region and the bearing region contiguous to it is designed as a fixed bearing and the other configuration as a loose bearing. This design proves to be particularly advantageous, since the arrangement with a covering element and with a carrying structure constitutes, in general, a system with high-grade mechanical redundancy. This system has a series of bearing configurations which are formed by the receiving regions and the contiguous bearing regions and, furthermore, by the mutually overlapping holding elements and carrying elements. The design with a fixed bearing and a loose bearing ensures that the covering element is mounted in a simple way in the carrying structure in the thermally nonloaded state.

Moreover, thermal expansion of the covering element along the longitudinal axis becomes possible. Thermal expansion takes place, in the case of a temperature rise, from the fixed bearing in the direction of the loose bearing. The fixed bearing configuration is in this case designed in such a way that, even in the case of only a slight temperature rise, as compared with room temperature, the corresponding receiving region and the bearing region contiguous to it come into contact with one another. By contrast, the loose bearing is dimensioned such that, even at very high temperatures, such as may occur when a gas turbine is in operation, the covering element can still expand along the longitudinal axis. This results here, in particular, in the advantages of a simple mounting and the arrangement, tolerant to thermal expansion, of the covering element in a carrying structure. Thermally induced deformations, in particular thermal expansions, are taken into account and, at the same time, the covering element is held firmly in the carrying structure via the holding elements at high temperatures.

Preferably, the fixed bearing has a tolerance of between about 0.2 mm and 0.5 mm. Also preferably, the loose bearing has a tolerance of between about 4.0 mm and 10.0 mm.

Preferably, the covering element and the carrying structure are arranged in a thermal machine, in particular in a gas turbine. The fastening concept tolerant to thermal expansion is particularly appropriate with regard to a platform for fixing a gas turbine blade, to a guide ring in a gas turbine, to a head platform of a guide blade of a gas turbine or to a heat shield element in the combustion chamber of a gas turbine. Where a gas turbine is concerned, a distinction is made between guide blades and moving blades which are in each case arranged on rings radially to the axis of rotation of the gas turbine. A guide blade has a platform which is arranged for fixing the guide blade on the inner turbine casing, in particular on the guide blade cascade segment. A moving blade is fastened via a platform on the turbine rotor arranged along the axis of rotation. A guide ring is arranged as a wall element in a gas turbine between the platforms of two successive guide blades spaced axially from one another. The outer surface of the guide ring is exposed to the hot medium, in particular the hot gas, and is spaced in the radial direction from the outer ends of the rotating moving blades by a gap. In addition to the applications in a gas turbine, further embodiments of the covering element are possible, for example as a wall element in furnaces, in combustion chambers or in vessels capable of being filled up with hot media.

BRIEF DESCRIPTION OF THE DRAWINGS

The invention is explained in more detail below by way of example with reference to some exemplary embodiments illustrated in the drawing in which, partially diagrammatically and in simplified form.

Identical reference symbols have the same significance in the individual figures.

DETAILED DESCRIPTION OF THE PREFERRED EMBODIMENTS

Figure 1:
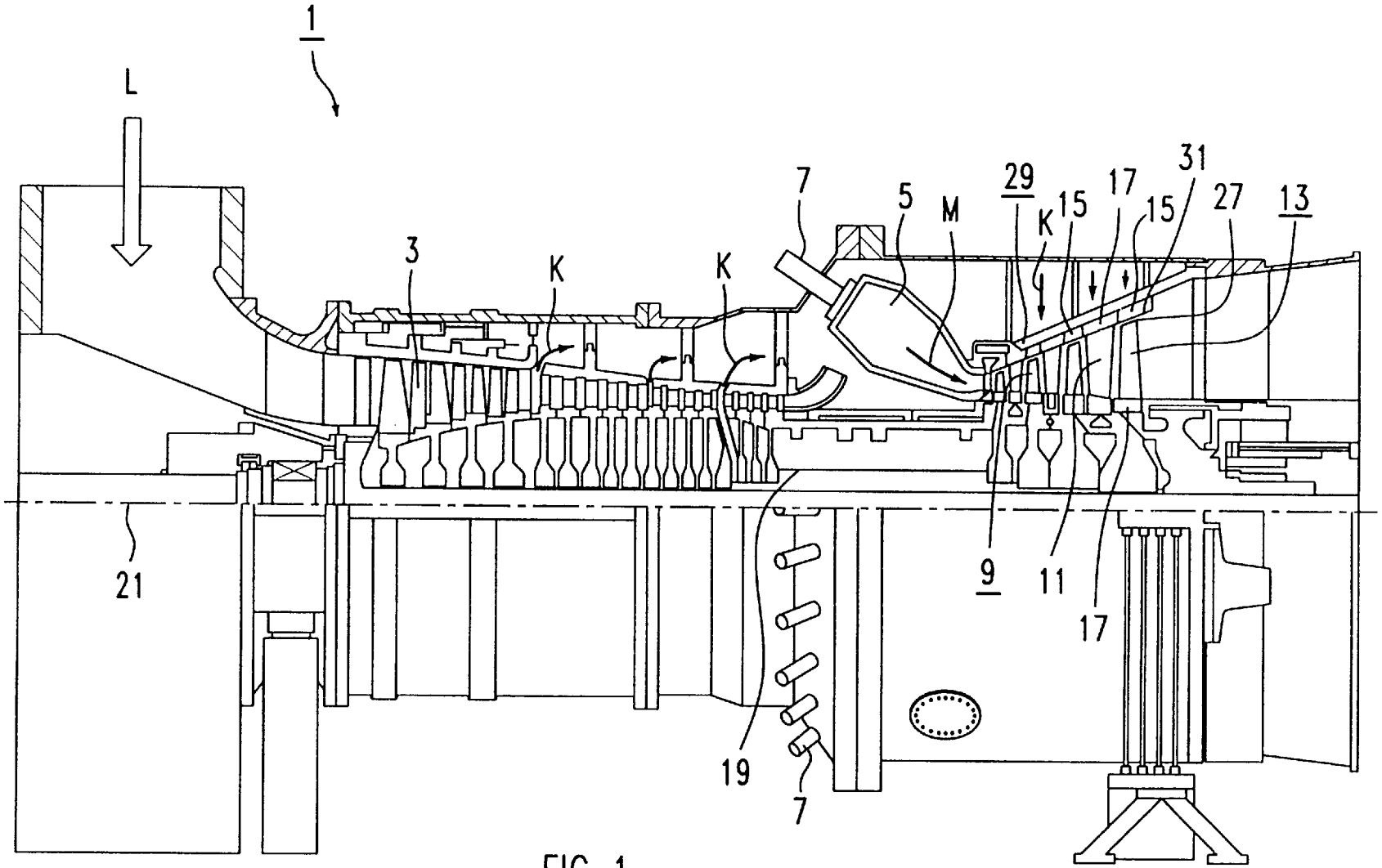
FIG. 1 shows a half section through a gas turbine with compressor, combustion chamber and turbine.

FIG. 1 illustrates a half section through a gas turbine 1. The gas turbine 1 has a compressor 3 for combustion air, a combustion chamber 5 with burners 7 for liquid or gaseous fuel, with heat shield elements, not shown in FIG. 1, arranged inside the combustion chamber 5 on the wall, and also a turbine 9 for driving the compressor 3 and a generator, not illustrated in FIG. 1. Fixed guide blades 11 and rotatable moving blades 13 are arranged in the turbine 9 on respective radially extending rings, not shown in the half section, along the axis of rotation 21 of the gas turbine 1. In this case, one pair succeeding along the axis of rotation 21 and including a ring of guide blades 11 (guide blade ring) and of a ring of moving blades 13 (moving blade ring) is designated as a turbine stage. Each guide blade 11 has a platform 17 which is arranged as a wall element for fixing the respective guide blade 11 to the inner turbine casing 29.

At the same time, this platform 17 is a component which is subjected to high thermal load and which forms the outer limitation of a hot medium M, in particular of the hot-gas duct in the turbine 9. The moving blade 13 is fastened via a corresponding platform 17 on the turbine rotor 19 arranged along the axis of rotation 21 of the gas turbine 1.

A guide ring 15 is arranged, as a covering element in a gas turbine 1, on the wall between the platforms 17 of two adjacent guide blades 11 spaced axially from one another. The outer surface 31 of the guide ring 15 is exposed to the hot medium M, in particular the hot gas, and is spaced in the radial direction from the outer end 27 of the moving blade 13 by a gap. The guide rings 15 arranged between adjacent guide blade rings serve as covering elements which protect against a thermal overstressing of casing fittings as a result of the transmission of heat from the flowing hot medium M.

When the gas turbine 1 is in operation, fresh air L is sucked in from the surroundings. The air L is compressed in the compressor 3 and is thereby simultaneously preheated. In the combustion chamber 5, the air L is brought together with the liquid or gaseous fuel and is burnt. A fraction of the air L previously extracted from the compressor 3 serves as cooling air K for cooling the turbine stages, for example the first turbine stage being subjected to a turbine inlet temperature of about 750° C. to 1200° C. In the turbine 9, an expansion and cooling of the hot medium M, in particular the hot gas, which flows through the turbine stages, take place.

Figure 2:
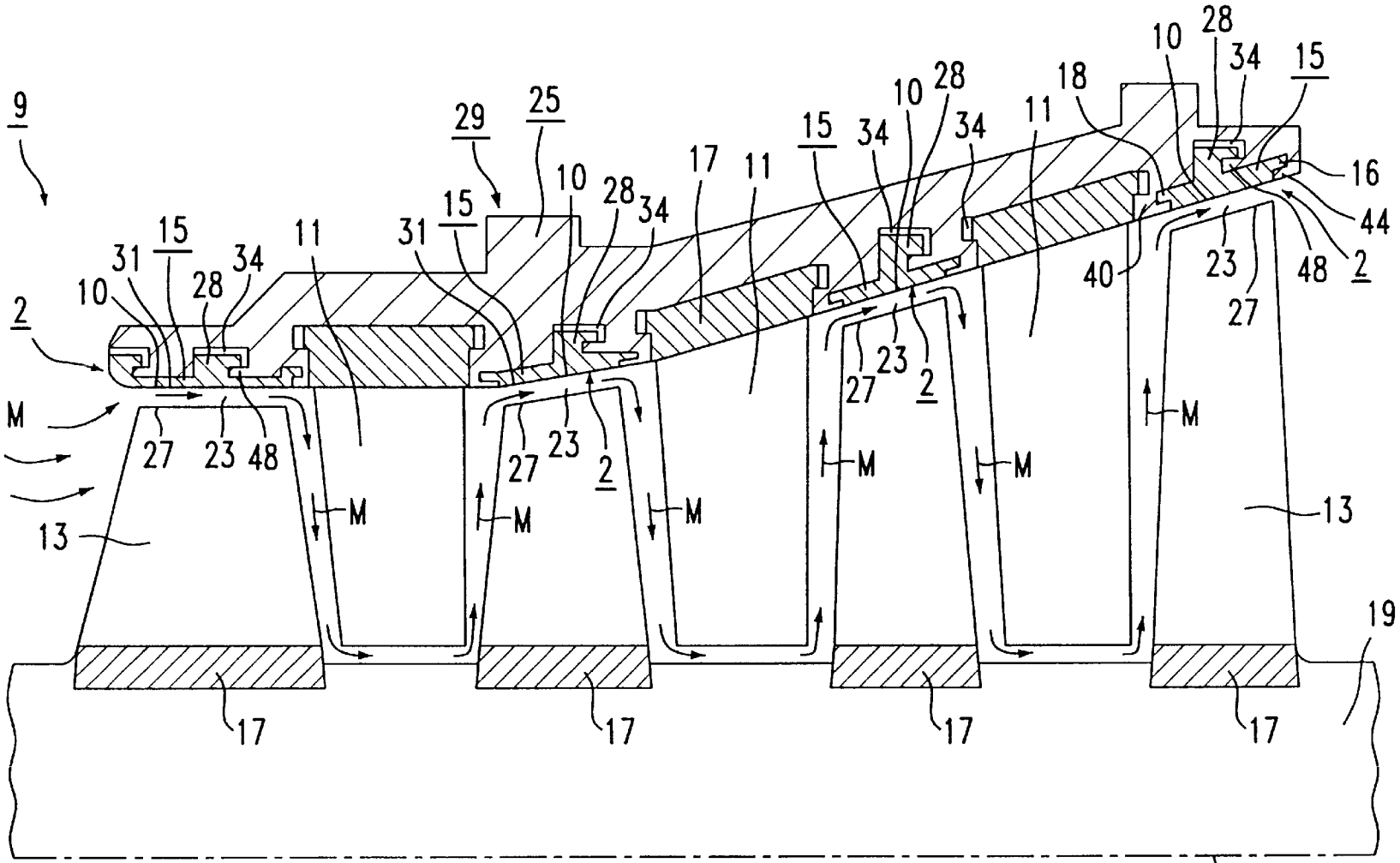
FIG. 2 shows a longitudinal section through a detail of a turbine.

FIG. 2 shows, in somewhat more detail, a longitudinal section through a detail of the turbine 9 illustrated in FIG. 1. Here, guide blades 11 and moving blades 3 are arranged successively along the axis of rotation 21 of the turbine 9. The guide blades 11 each have a platform 17 which is arranged as a wall element for fixing the guide blade 11 to the inner turbine casing 29, shown only incompletely in FIG. 2. The inner turbine casing 29 has a radially arranged guide blade cascade segment 25, in which a carrying structure 34 is formed in the direction of the axis of rotation 21. The carrying structure 29 receives the platforms 17 of the guide blades 11 and thereby fixes the guide blades 11. The moving blades 13 are fastened, in each case via a platform 17, to the turbine rotor 19 arranged along the axis of rotation 21. Guide rings 15 are arranged as covering elements 2 in the turbine 9 between the platforms 17 of two successive guide blades 11 spaced axially from one another.

The outer surface 31 of a covering element 2, in particular of a guide ring 15, is exposed to the hot medium M, in particular the hot gas, and is spaced in the radial direction from the outer end 27 of the moving blades 13 by a gap 23. The outer surface 31 forms the hot side 10 of the cover-ing element 2. The carrying structure 34, illustrated in FIG. 2, of the guide blade cascade segment 25 is designed in such a way that it receives the guide blades 11 from a plurality of turbine stages.

Between two guide blades 11 succeeding one another along the axis of rotation 21 of the turbine 9, the guide blade cascade segment 25 is effectively protected against thermal overstressing due to the transmission of heat from the flowing hot medium M, in particular the hot gas, by means of covering elements 2 which each constitute a guide ring 15 arranged in the carrying structure 34. In this case, the guide rings 15 are inserted in the carrying structure 34 in such a way that the first receiving region 40 of the carrying structure 34 is contiguous to the first bearing region 18 of the covering element 2 and the second receiving region 44 of the carrying structure 34 is contiguous to the second bearing region 16 of the covering element 2, and the holding element 28 of the covering element 2 and the carrying element 48 of the carrying structure 34 overlap one another. The guide ring 15 is thereby fastened in the guide blade cascade segment 25 of the turbine 9 in a way which is tolerant to thermal expansion, with the result that, in particular, the gap dimension of the gap 23, that is to say the spacing between the outer end 27 of the moving blade 13 and the hot side 10 of the guide ring 15, can be set to a defined dimension. The detailed embodiment and functioning of this fastening concept which is elastic in terms of thermal expansion is explained in detail in FIGS. 8 and 9.

Figure 3:
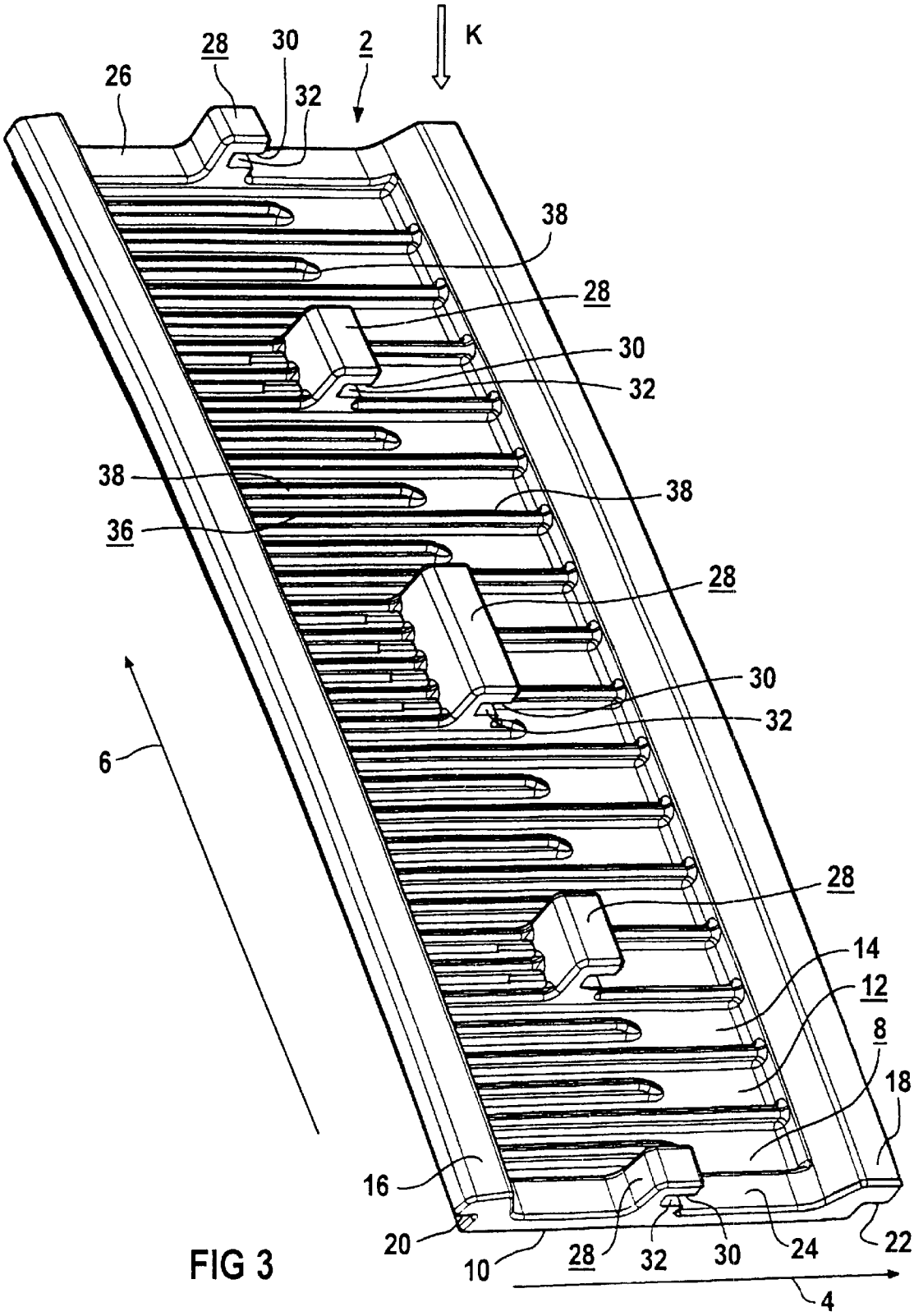
FIG. 3 shows a perspective illustration of a guide ring of a gas turbine.

A perspective illustration of a guide ring 15 of a gas turbine 1 is shown in FIG. 3. The guide ring 15 extends along a longitudinal axis 4 and a transverse axis 6. It comprises a wall 8 with a hot side 10 capable of being exposed to a hot medium and with a cool side 12 which is located opposite the hot side 10 and which has a cooling surface 14 capable of being acted upon by a coolant K. A first bearing region 16 having a first bearing surface 20 is contiguous to the wall 8 of the guide ring 15 along a longitudinal axis 4. A second bearing region 18 having a second bearing surface 22 is contiguous to the wall 8 along the longitudinal axis 4 and is located opposite the first bearing region 16. The guide ring 15 has, furthermore, a first edge region 24 contiguous to the wall 8 along the transverse axis 6 and a second edge region 26 located opposite the first edge region 24 along the transverse axis 6. The wall 8 is in this case made thin, in comparison with the first/second edge region 24, 26 and with a first/second bearing region 16, 18.

Provided on the cool side 12 of the wall 8 are holding elements 28 which are arranged between the first and the second bearing region 20, 22. In this case, five holding elements 28 are arranged along the transverse axis 6 on the cool side 12 of the wall 8. Thus, the first and the second edge region 24, 26 each have a holding element 28, while three holding elements 28 are arranged on the cooling surface 14 of the wall 8. The holding elements 28 are a fixed integral part of the guide ring 15 and have the function of ensuring an additional hold between the first and the second bearing region 16, 18. The guide ring 15 may in this case be held by the holding elements 28 from the cool side, in such a way that, in particular, forces directed perpendicularly to the wall, for example as a result of mechanical and/or thermal load on the wall 8, can be absorbed and, if appropriate, also transmitted efficiently. The holding elements 28 each have a recess 32, in particular a groove, with a holding bearing surface 30. The respective recess 32 in the holding elements 28 is provided for engaging into a carrying structure 34 not shown in FIG. 3 (see FIGS. 8 and 9).

What is thereby achieved by way of the holding elements 28, in combination with the first and the second bearing region 16, 18 and with a carrying structure 34, not illustrated in FIG. 3, is a connection, tolerant to thermal expansion, between the guide ring 15 and the carrying structure 34. Since the first and the second bearing region 16, 18 are contiguous to the wall 8 along the longitudinal axis 4, that side of the wall 8 which is located opposite the hot medium M is available virtually completely as a cooling surface 14. By virtue of this design, the cooling surface 14 is capable of being acted upon uniformly by a coolant K, for example cooling air, with the result that highly homogeneous cooling becomes possible.

The holding elements 28 are arranged, spaced from one another, along the transverse axis 6, with the result that the cooling surface 14 is designed as a coherent surface and, consequently, the coolant K, in as much as it is supplied at a point on the cool side 12, can reach all the regions of the cooling surface 14. An unimpeded and uniform distribution of the coolant K along the cooling surface 14 is thereby ensured, and thus also particularly efficient area-covering heat discharge. The cooling surface 14 has a supporting structure 36. This serves for increasing the rigidity and thermal conductivity of the guide ring 15. This supporting structure is formed by a row of equidistant longitudinal ribs 38 which cover the cooling surface 14 uniformly along the transverse axis 6.

Provided in this case are both longitudinal ribs 38, which extend from the first bearing region 16 to the second bearing region 18 of the guide ring 15, and longitudinal ribs 38, which extend from the first bearing region 16 along the longitudinal axis 4 and end between the first bearing region 16 and the second bearing region 18 of the guide ring 15 on the cooling surface 14. The supporting structure 36 prevents deformations, in particular deformations and flexions of the wall 8 in the direction of the hot side 10 of the wall 8.

Furthermore, this supporting structure 36 ensures an enlargement of the effective cooling surface 14, thus leading to an increase in cooling efficiency. In addition to enlarging the effective cooling surface 14, the supporting structure 36 additionally brings about an improved intermixing of coolant K at different temperature in the immediate vicinity of the cooling surface 14. As a result, on average, a decrease in the temperature on the cooling surface 14 is achieved, and the temperature gradient and, correspondingly, the transport of heat by the coolant K are increased. In addition, since the cross section of the supporting structure 36 is larger than that of the wall 8, the thermal conductivity is increased somewhat along the supporting structure.

The holding elements 28 arranged on the covering surface 14 are connected to at least three longitudinal ribs 38 spaced from one another in the direction of the transverse axis 6. By virtue of this design, the holding elements 28 on the cooling surface 14 may be interpreted, as it were, as part of the supporting structure 36. This design serves both for increasing the rigidity and for increasing the thermal conductivity. But, most of all, the design serves to increase mechanical and thermal stability of the guide ring 15 under a high thermal and/or compressive load, in particular in the case of alternating thermal load. Simple forms of production of the guide ring 15 having these favorable properties, for example as a casting, are possible.

Figure 4:
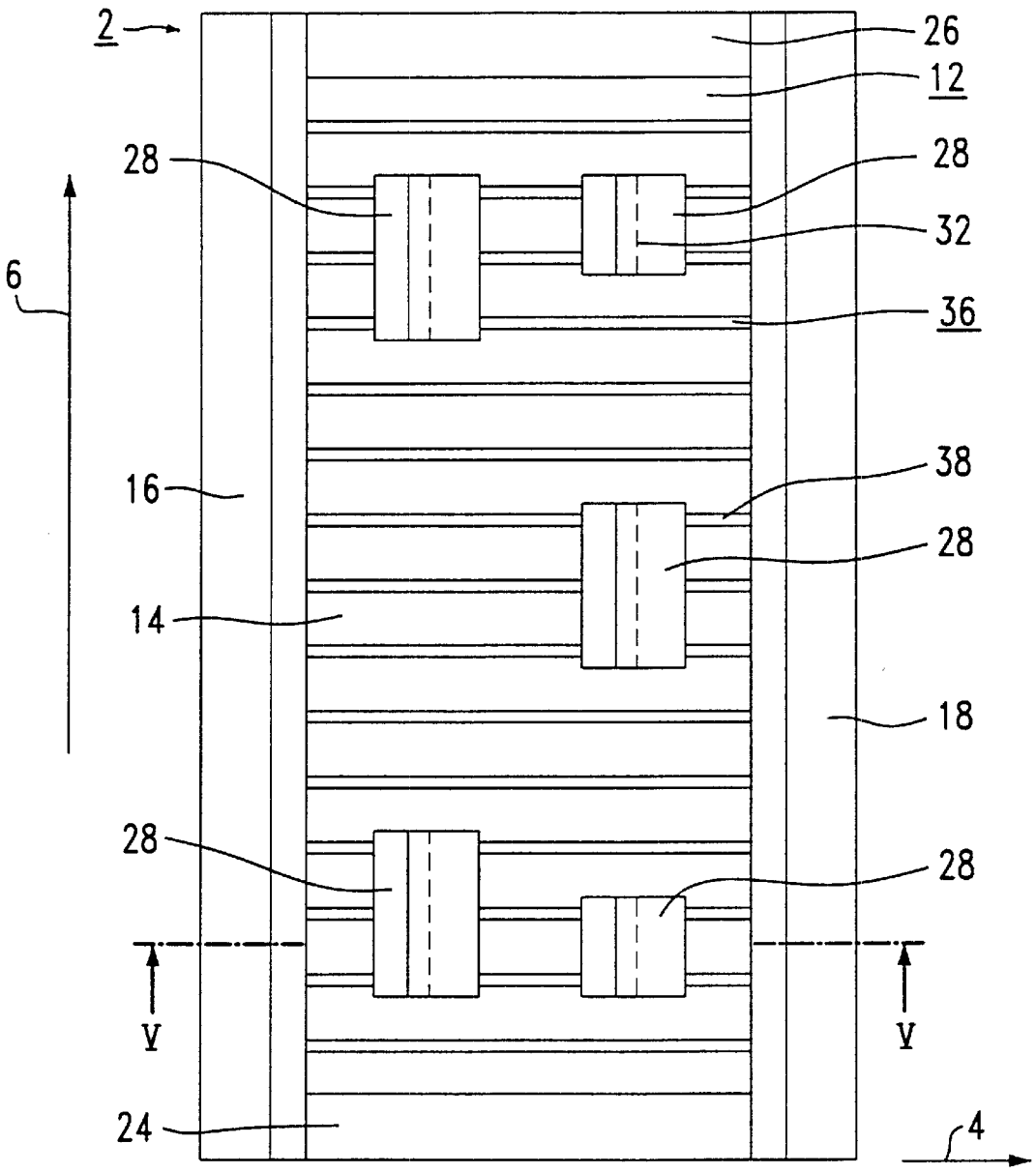
FIG. 4 shows a top view of a guide ring of a gas turbine with cooling surface and holding elements.
Figure 5:
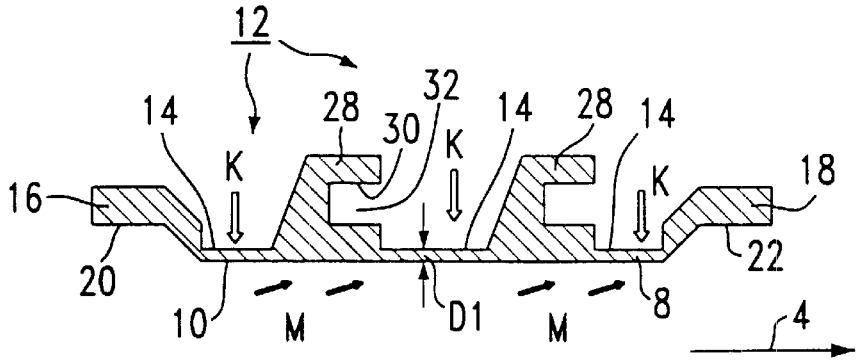
FIG. 5 shows a view of the guide ring shown in FIG. 4, along the sectional line VI—VI.

FIG. 4 shows a guide ring 15 of a gas turbine 1, with an arrangement of the holding elements 28 and an embodiment of the longitudinal ribs 38 of the cool side 12 which are alternative to those according to FIG. 3, and FIG. 5 shows a view of the guide ring 15 shown in FIG. 4, along the sectional line VI—VI. In this case, FIG. 4 shows a top view of the cool side 12 of the guide ring 15, the cool side having a cooling surface 14 capable of being acted upon by a coolant. The cooling surface 14 is limited along the longitudinal axis 4 by a first bearing region 16 and a second bearing region 18 located opposite the first bearing region 16 along the longitudinal axis. The cooling surface 14 is limited along the transverse axis 6 by a contiguous first edge region 24 and a second edge region 26 located opposite the first edge region 24 along the transverse axis 6.

In contrast to the exemplary embodiment shown in FIG. 3, the five holding elements 28 are arranged solely on the cooling surface 14, that is to say the first and the second edge region 24, 26 of the guide ring 15 do not have any holding elements 28 here. On the cooling surface 14 there is a supporting structure 36 in the form of equidistant longitudinal ribs 38 which extend from the first bearing surface 16 along the longitudinal axis 4 to the second bearing region 18 and which cover the cooling surface 14 uniformly from the first edge region 24 to the second edge region 26.

In this case, at least two longitudinal ribs 38 spaced from one another in the direction of the transverse axis 6 are connected to a holding element 28. Five holding elements 28 are arranged, spaced from one another, on a cooling surface 14. The cooling surface 14 is thereby designed as a coherent surface, and a coolant K, in particular cooling air L, can flow, unimpeded, from one point on the cooling surface 14 to any other point on the cooling surface 14. Complicated coolant feeds or coolant leadthroughs consequently become unnecessary, and a particularly efficiently coolable guide ring 15 is provided.

A sectional view, shown in FIG. 5, of the guide ring 15 shown in FIG. 4 shows a wall 8 with a hot side 10 capable of being exposed to a hot medium and with a cool side 12 which is located opposite the hot side 10 and which has a cooling surface 14 capable of being acted upon by a coolant K. A first bearing region 16 having a first bearing surface 20 is contiguous to the wall 8 along the longitudinal axis 4. A second bearing region 18 having a second bearing surface 22 is contiguous to the wall 8 along the longitudinal axis 4 and is located opposite the first bearing region 16.

Two holding elements 28 are arranged, spaced from one another, on the cooling surface 14 along the longitudinal axis 4, a coherent cooling surface 14 being formed. The holding elements 28 each have a recess 32, in particular a groove, with the holding bearing surface 32 for engaging into a carrying structure 34 not shown in FIG. 5 (see FIGS. 8 and 9).

The wall 8 is produced with a wall thickness D1 which is made comparatively thin, as compared with the wall thickness of the first and the second bearing region 16, 18. The wall thickness D1 is about 1.0 mm to 5.0 mm, in particular about 1.5 mm to 3.0 mm. This has an advantageous effect on the cooling properties of the guide ring 15. Depending on the application, the temperature difference between the hot side 10, capable of being acted upon by the hot medium M, and the cool side 12, capable of being acted upon by the coolant K, of the wall 8 may be very large. For example, when the guide ring 15 is used in a gas turbine 1, temperature differences between the hot gas and the cooling air up to 800° C. may occur.

It is therefore beneficial to make the wall 8 as thin as possible, so that the temperature gradient between the hot side 10 and the cool side 12 of a wall 8 becomes as high as possible and the heat can be discharged very efficiently, with as small an amount of coolant as possible being used. An efficient heat discharge in this case takes place predominantly by means of the cooling air K. However, a smaller fraction of the heat flow flowing from the hot side 10 into the wall 8 is also diverted along the longitudinal axis of the transverse axis into the first/second bearing region and the first/second edge region of the covering element, since these regions form a heatsink because their cross section is larger than that of the wall 8.

Figure 6:
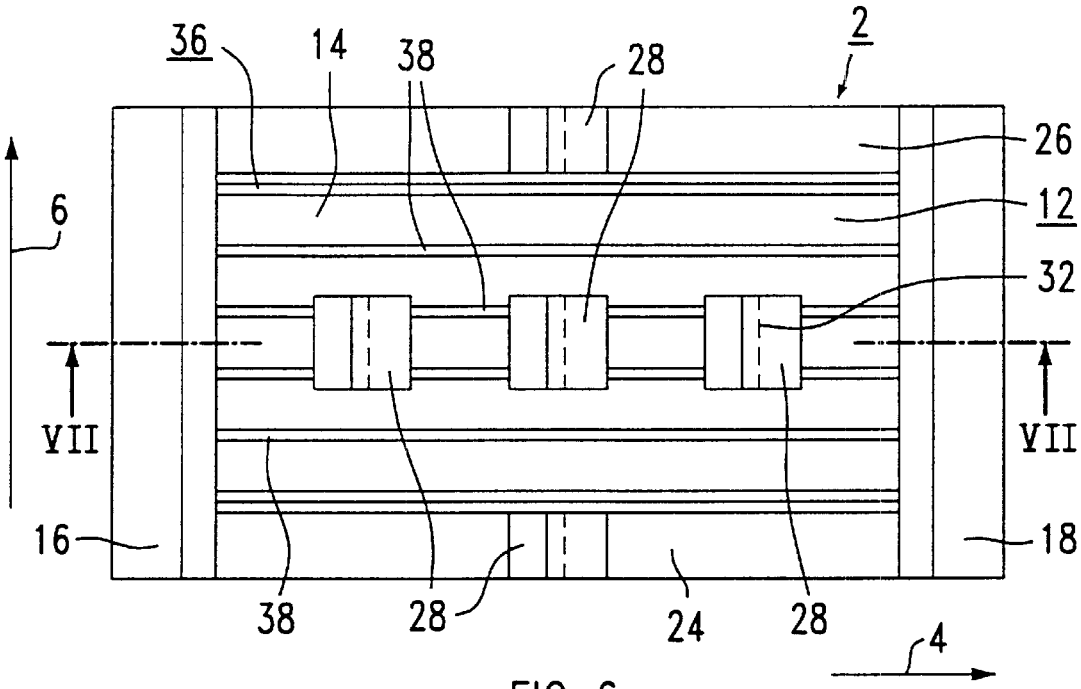
FIG. 6 shows a further exemplary embodiment (top view) for a guide ring of a gas turbine with cooling surface and holding elements.
Figure 7:
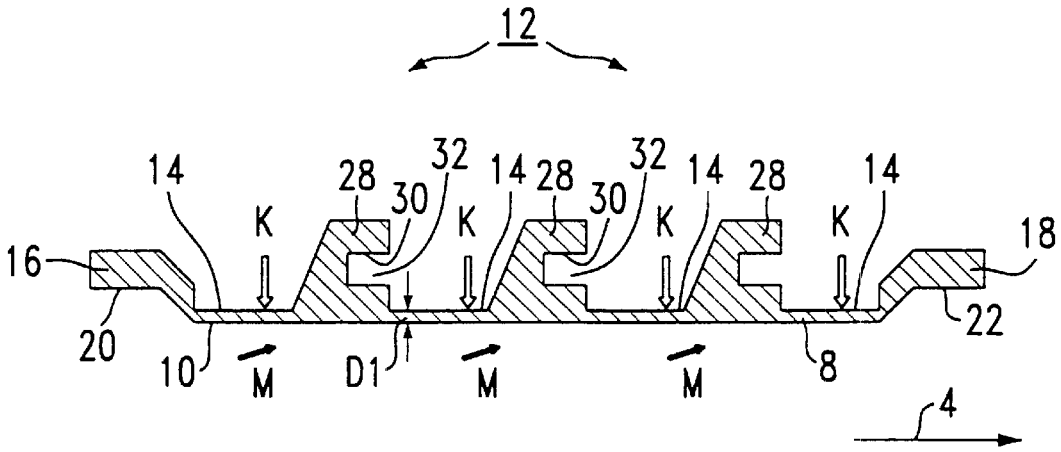
FIG. 7 shows a view of the guide ring illustrated in FIG. 6, along the sectional line VII—VII.

FIG. 6 shows a further exemplary embodiment of a guide ring 15 of a gas turbine 1 with a cooling surface 14 and holding elements 28, and FIG. 7 shows a view of the guide ring 15 illustrated in FIG. 5, along the sectional line VII—VII. The guide ring 15 shown is dimensioned such that it extends predominantly along the longitudinal axis 4. The longitudinal axis 4 consequently forms the preferred direction of expansion of the guide ring 15. Consequently, three holding elements 28 are arranged, spaced from one another, on the cooling surface 14 along the longitudinal axis 4, a coherent cooling surface 14 being formed.

Furthermore, the first edge region 24 and the second edge region 26 each have a holding element 28. A supporting structure 36 in the form of equidistant longitudinal ribs 38 is formed on the cooling surface 14 along the longitudinal axis 4. The longitudinal ribs 38 extend, in this case, from the first bearing region 16 to the second bearing region 18 and cover the cooling surface 14 uniformly along the transverse axis 6 of the guide ring 15. The holding elements 28 are each provided with a recess 32 which has a holding bearing surface 30. The recesses 32 are designed, here, as grooves which serve for engaging into a carrying structure 34 not shown in FIG. 6 (see FIGS. 8 and 9).

The sectional view VII—VII in FIG. 7 shows a wall 8 with a hot side 10 capable of being exposed to a hot medium M and with a cool side 12 which is located opposite the hot side 10 and which has a cooling surface 14 capable of being acted upon by a coolant. The first bearing region 16 contiguous to the wall 8 along the longitudinal axis 4 has a first bearing surface 20. A second bearing region 18 with a second bearing surface 22 is contiguous to the wall 8 along the longitudinal axis 4 and is located opposite the first bearing region 16. In a similar way to the exemplary embodiments of FIGS. 4 and 5, the wall 8 is made comparatively thin, as compared with the first and the second bearing region 16, 18.

When a gas turbine is in operation, that is to say under high thermal and mechanical load, the wall 8 of the guide ring 15 tends to flex in the direction of the hot side 10. The flexion of the wall 8 which occurs depends in this case on the temperature and pressure conditions to which the guide ring 15 is subjected and on the material properties and the design of the guide ring 15, particularly with regard to the number and arrangement of the holding elements 28 on the cooling surface 14.

In the case of a typical temperature difference between the hot side 10 and the cool side 12 of the guide ring 15 of about 800° C., such as occurs, for example, in a steady-state gas turbine 1, values of between 0.1 mm and 0.7 mm are obtained for a thermal flexion of the wall 8. In an actual set object, a suitable configuration for the guide ring 15 will be achieved during the design and rating of a gas turbine 1, for example by means of a computer-assisted optimizing process.

In this case, the concurrent requirements between the flexion of the wall 8, on the one hand, and, in accompaniment with this, the number and arrangement of the holding elements 28 on the cooling surface 14, and as large an effective cooling surface 14 as possible, on the other hand, are taken into account.

The exemplary embodiments show that the proposed concept affords a high degree of flexibility of terms of an actual set object.

Figure 8:
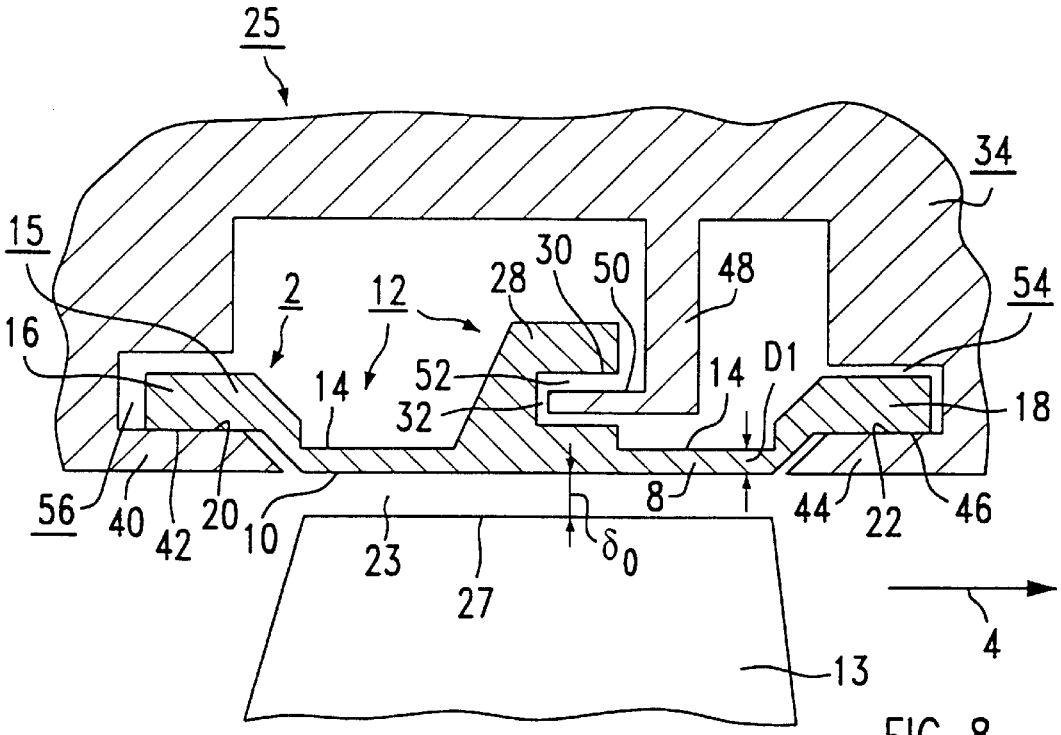
FIG. 8 shows a longitudinal section through an arrangement of a guide ring in the guide blade cascade segment of a gas turbine without any thermal load (at room temperature)

FIG. 8 shows a longitudinal section through an arrangement of a covering element 2, which constitutes a guide ring 15, in the guide blade cascade segment 25 of a gas turbine 1 without any thermal load, that is to say at room temperature. The guide ring 15 comprises a wall 8 with a wall thickness D1 and with a hot side 10 capable of being exposed to a hot medium M and a cool side 12 which is located opposite the hot side and which has a cooling surface 14 capable of being acted upon by a coolant K. A first bearing region 16 having a first bearing surface 20 is contiguous to the wall 8 along the longitudinal axis 4 of the wall 8. A second bearing region 18 having a second bearing surface 22 is contiguous to the wall 8 along the longitudinal axis 4 and is located opposite the first bearing region 16.

Arranged on the cooling surface 14 is a holding element 28 which has a recess 32, in particular a groove, and a holding bearing surface 30. The holding element 28 is designed and arranged on the cooling surface 14 in such a way that a coherent cooling surface 14 is thereby formed. The guide blade cascade segment 25 has a carrying structure 34, into which the guide ring 15 is inserted. The carrying structure 34 extends along a longitudinal axis 4 and has a first receiving region 40 with a first receiving surface 42 and a second receiving region 44, located opposite along the longitudinal axis, with a second receiving surface 46, and also a carrying element 48 with a carrying surface 50. The guide ring 15 is arranged in the carrying structure 34 in such a way that the first receiving region 40 is contiguous to the first bearing region 16 and the second receiving region 44 is contiguous to the second bearing region 18, and the holding element 28 and carrying element 48 overlap one another, the holding bearing surface 30 and the carrying surface 50 being located opposite one another.

Thus, in the case shown here without any thermal load, that is to say at room temperature, the holding bearing surface 30 and the carrying surface 50 are spaced from one another by a gap 52. The configuration formed between the first receiving region 40 and the first bearing region 16 contiguous to it is designed as a loose bearing 56. The configuration formed between the second receiving region 44 and the second bearing region 18 contiguous to it is designed as a fixed bearing 54.

The design with a fixed bearing 54 and a loose bearing 56 makes it easier to mount the guide ring 15 in the carrying structure 34 in the thermally nonloaded state. At the same time, in the event of load, a thermal expansion of the guide ring 15 along the longitudinal axis 4 becomes possible. In the case of a temperature rise, the thermal expansion takes place from the fixed bearing 54 in the direction of the loose bearing 56. The fixed bearing configuration is in this case designed in such a way that, even in the event of only a slight temperature rise in relation to room temperature, the second receiving region 44 and the second bearing region 18 contiguous to it come into contact with one another. The fixed bearing is designed with a tolerance of between about 0.2 mm and 0.5 mm.

By contrast, the loose bearing 56 is dimensioned such that, even at high temperatures, the guide ring 15 can expand along the longitudinal axis 4. In the arrangement, the loose bearing has a tolerance of between about 4 mm and 10 mm. The guide ring 15 is normally inserted into the carrying structure 34 at room temperature. Since the first receiving region 40 is contiguous to the first bearing region 16 and the second receiving region 44 to the second bearing region 18, the guide ring 15 is already held in the carrying structure 34.

The spacing of the holding bearing surface 30 of the holding element 28 and the carrying surface 50 of the carrying element 48 by way of a gap 52 makes it easier to mount the guide ring 15 in the carrying structure 34. The guide ring 15 is arranged, as a covering element 2 in a gas turbine 1, between the platforms, not shown in FIG. 8, of two guide blades 7 spaced axially from one another (see FIGS. 1 and 2). The gap 23 which is formed between the outer end 27 of the moving blade 13 and the hot side 10 of the wall 8 has a gap dimension $\delta_0$ at room temperature.

Figure 9:
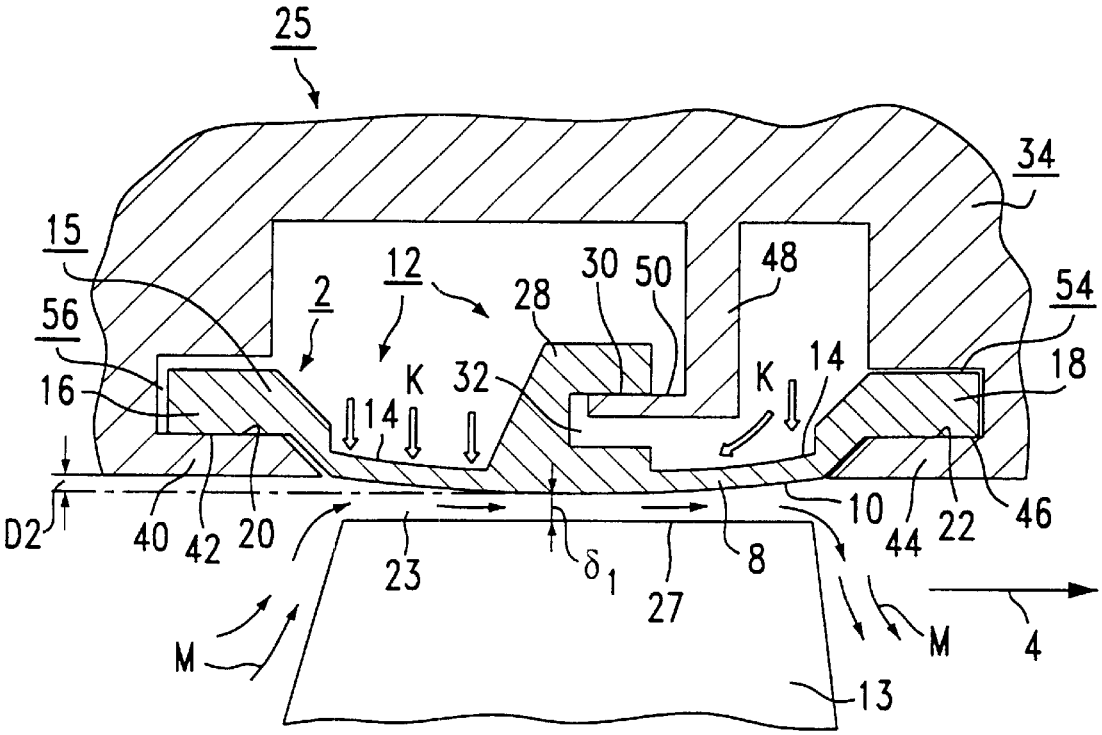
FIG. 9 shows a longitudinal section through an arrangement of a guide ring in the guide blade cascade segment of a gas turbine under thermal load.

FIG. 9 illustrates the behavior of the system discussed in FIG. 8 under thermal load, that is to say when a steady-state gas turbine 1 is in operation. When the gas turbine 1 is in operation, that is to say under high thermal and mechanical load, the wall 8 of the guide ring 15 tends to flex in the direction of the hot side 10. The holding bearing surface 30 and the carrying surface 50 thereby come into congruence, and the forces resulting from the thermal and mechanical load are effectively absorbed. The spacing, selected at room temperature, between the holding bearing surface 30 and the carrying surface 50 (cf. FIG. 8) have a decisive influence on the thermal load at which the holding bearing surface 30 and the carrying surface 50 come into congruence and consequently on the resulting thermal flexion D2 of the wall 8.

In the thermally highly loaded state, therefore, the guide ring 15 is held firmly in the carrying structure 34. The gap 23 formed between the hot side 10, which is exposed to the hot medium M, in particular the hot gas, and the outer end 27 of the moving blade 13 has a gap dimension $\delta_1$ which is smaller than the gap dimension $\delta_0$ at room temperature (cf. FIG. 8).

The difference between these gap dimensions $\delta_0$, $\delta_1$, corresponds approximately to the thermal flexion D2 of the wall 8. The thermal flexion D2 which occurs depends, in this case, on the thermal and compressive load on the guide ring 15 and on the material properties and the design, particularly with regard to the number and arrangement of holding elements 28 on the cooling surface 14. The gap dimension $\delta_1$ can be set to a predetermined dimension which is as small as possible by means of an appropriate design of the arrangement shown. The gap losses as a result of the mass flow of hot medium M, in particular of hot gas, through the gap 23 can therefore be minimized, this having a positive effect on the turbine efficiency.

At the same time, during operation, the rotating moving blade 13 can be reliably prevented from rubbing against the guide ring 15. Since the pressure difference between the cool side 12 and the hot side 10 of the guide ring 15 when coolant K acts constantly and uniformly upon the cooling surface 14 along the longitudinal axis 4 increases continuously as a result of the expansion of the hot medium M along the longitudinal axis 4, preferably the bearing configuration formed downstream is designed as a fixed bearing 54 and the bearing configuration formed upstream is designed as a loose bearing 56. This ensures free thermal expansion of the guide ring 15 along the longitudinal axis 4. In the event of a temperature rise, thermal expansion takes place from the fixed bearing 54 in the direction of the loose bearing 56.

The fixed bearing configuration, in particular the fixed bearing 44, is in this case designed in such a way that, even in the case of only a slight temperature rise in relation to room temperature, the receiving region 44 and the bearing region 18 contiguous to it come into contact with one another. Thus, in particular, the receiving surface 40 and the bearing surface 22 are located directly opposite one another. By contrast, the loose bearing 56 is designed in such a way that, even under high thermal loads, the guide ring 15 can expand sufficient along the longitudinal axis 4.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A covering element including a longitudinal axis and a transverse axis, comprising:

a wall with a hot side capable of being exposed to a hot medium and with a cool side located opposite the hot side and including a cooling surface capable of being acted upon by a coolant;

a first bearing region contiguous to the wall along the longitudinal axis and including a first bearing surface and a second bearing region located opposite the first bearing region along a longitudinal axis and including a second bearing surface;

a first edge region contiguous to the wall along the transverse axis and a second edge region located opposite the first edge region along the transverse axis wherein, a holding element, arranged between the first and the second bearing region, is provided on the cool side; and a further holding element, arranged on the cooling surface on at least one of the first and on the second edge region.

2. The covering element as claimed in claim 1 wherein the holding element includes a holding bearing surface.

3. The covering element as claimed in claim 2, wherein the holding element includes a recess, for engaging into a carrying structure.

4. The covering element as claimed in claim 1, wherein the holding element includes a recess, for engaging into a carrying structure.

5. The covering element of claim 4, wherein the recess is a groove.

6. The covering element as claimed in claim 1, wherein the wall includes a wall thickness of between about 1.0 mm and about 5.0 mm.

7. The covering element of claim 6, wherein the wall thickness is between about 1.5 mm and about 3.0 mm.

8. The covering element as claimed in claim 1, wherein the cooling surface includes a supporting structure for increasing the rigidity and thermal conductivity.

9. The covering element as claimed in claim 8, wherein the supporting structure is formed by at least one longitudinal rib on the cooling surface along the longitudinal axis.

10. The covering element as claimed in claim 9, wherein the supporting structure includes a further longitudinal rib formed on the cooling surface along the longitudinal axis.

11. The covering element as claimed in claim 6, wherein at least two longitudinal ribs spaced from one another in the direction of the transverse axis are connected to a holding element.

12. The covering element as claimed in claim 9, wherein at least two longitudinal ribs spaced from one another in the direction of the transverse axis are connected to a holding element.

13. An arrangement including a covering element as claimed in claim 1 and including a carrying structure comprising:

a) a longitudinal axis and a transverse axis, b) a first receiving region arranged along the longitudinal axis and including a first receiving surface, c) a second receiving surface located opposite along the longitudinal axis and including a second receiving surface, and d) a carrying element including a carrying surface, wherein the first receiving region is contiguous to the first bearing region, the second receiving region is contiguous to the second bearing region, and the holding element and carrying element overlap one another, the holding bearing surface and the carrying surface being located opposite one another.

14. The arrangement as claimed in claim 13, wherein the covering element and the carrying structure are arranged in a thermal machine.

15. The covering element as claimed in claim 1, wherein the holding element includes a holding bearing surface.

16. The covering element as claimed in claim 1, wherein the holding element includes a recess, for engaging into a carrying structure.

17. A covering element including a longitudinal axis and a transverse axis, comprising:

a wall with a hot side capable of being exposed to a hot medium and with a cool side located opposite the hot side and including a cooling surface capable of being acted upon by a coolant;

a first bearing region contiguous to the wall along the longitudinal axis and including a first bearing surface and a second bearing region located opposite the first bearing region along a longitudinal axis and including a second bearing surface; and a first edge region contiguous to the wall along the transverse axis and a second edge region located opposite the first edge region along the transverse axis wherein, a holding element, arranged between the first and the second bearing region, is provided on the cool side, wherein at least two holding elements are arranged, spaced from one another, along the transverse axis, and wherein the number and arrangement of the holding elements are defined by a predetermined thermal flexion of the wall.

18. The covering element as claimed in claim 17, wherein the predetermined thermal flexion is about 0.1 mm to about 1.0 mm.

19. The covering element of claim 18, wherein the predetermined thermal flexion is about 0.3 mm to about 0.7 mm.

20. The covering element as claimed in claim 18, wherein at least two holding elements are arranged, spaced from one another, along the transverse axis.

21. The covering element as claimed in claim 18, wherein at least two holding elements are arranged, spaced from one another, along the longitudinal axis.

22. The covering element as claimed in claim 17, wherein at least two holding elements are arranged, spaced from one another, along the longitudinal axis.

23. The covering element as claimed in claim 17, wherein at least two holding elements are arranged, spaced from one another, along the longitudinal axis.

24. An arrangement including a carrying structure, comprising:

a longitudinal axis and a transverse axis, a first receiving region arranged along the longitudinal axis and including a first receiving surface, a second receiving surface located opposite along the longitudinal axis and including a second receiving surface, and a carrying element including a carrying surface, wherein the first receiving region is contiguous to a first bearing region contiguous to a wall of the covering element, including a hot side and a cool side, the second receiving region is contiguous to a second bearing region of the covering element located opposite the first bearing region, and wherein a holding element arranged between the first and second bearing region and the carrying element overlap one another, a holding bearing surface of the holding element and the carrying surface being located opposite one another, wherein without any thermal load, the holding bearing surface and the carrying surface are spaced from one another by a gap.

25. The arrangement of claim 24, wherein the hold bearing surface and the carrying surface are spaced without any thermal load, at room temperature.

26. The arrangement as claimed in claim 24, wherein a configuration is formed between the receiving region and the bearing region contiguous to it, is designed as a fixed bearing and wherein the other configuration is designated as a loose bearing.

27. The arrangement as claimed in claim 24, wherein the covering element and the carrying structure are arranged in a thermal machine.

28. An arrangement including a carrying structure, comprising:

a longitudinal axis and a transverse axis, a first receiving region arranged along the longitudinal axis and including a first receiving surface, a second receiving surface located opposite along the longitudinal axis and including a second receiving surface, and a carrying element including a carrying surface, wherein the first receiving region is contiguous to a first bearing region contiguous to a wall of the covering element, including a hot side and a cool side, the second receiving region is contiguous to a second bearing region of the covering element located opposite the first bearing region, and wherein a holding element arranged between the first and second bearing region and the carrying element overlap one another, a holding bearing surface of the holding element and the carrying surface being located opposite one another, wherein a configuration is formed between the receiving region and the bearing region contiguous to it, is designed as a fixed bearing and wherein the other configuration is designated as a loose bearing.

29. The arrangement as claimed in claim 28, wherein the fixed bearing includes a tolerance of between about 0.2 mm and about 0.5 mm.

30. The arrangement as claimed in claim 29, wherein the covering element and the carrying structure are arranged in a thermal machine.

31. The arrangement as claimed in claim 28, wherein the loose bearing includes a tolerance of between about 4 mm and about 10 mm.

32. The arrangement as claimed in claim 31, wherein the covering element and the carrying structure are arranged in a thermal machine.

33. The arrangement as claimed in claim 28, wherein the covering element and the carrying structure are arranged in a thermal machine.

* * * * *